US006012170A

United States Patent [19]

Kim

[11] Patent Number: 6,012,170

[45] Date of Patent: Jan. 11, 2000

[54] METHOD AND APPARATUS FOR AN INSULATED GLOVE OR MITTEN WITH EASY TO BEND FINGER AND THUMB PORTIONS

[76] Inventor: Joo-In Kim, 250-3 Nonhyun-Dong, Kangnam-Gu, Seoul, Rep. of Korea

[21] Appl. No.: 09/169,932

[22] Filed: Oct. 13, 1998

[51] Int. Cl.[7] ..... A41D 19/00

[52] U.S. Cl. ..... 2/164; 2/163; 2/158

[58] Field of Search ..... 2/158, 159, 161.1, 2/161.2, 161.5, 161.6, 163, 167, 169, 16; 473/59, 61, 205, 450, 464, 615

[56] References Cited

U.S. PATENT DOCUMENTS 3,151,334 10/1964 Haupt et al. .
3,251,067 5/1966 Shmikler .
3,869,726 3/1975 Bell .
4,430,759 2/1984 Jackrel .
4,545,841 10/1985 Jackrel .
4,662,006 5/1987 Ross, Jr. .
4,679,257 7/1987 Town .
4,733,413 3/1988 Dykstra .
4,741,052 5/1988 Rubin .
4,847,918 7/1989 Sturm .
5,123,119 6/1992 Dube .
5,167,038 12/1992 Rinehart .
5,442,818 8/1995 Loos .
5,568,656 10/1996 Kim .

*Primary Examiner*—Diana Oleksa
*Assistant Examiner*—Kate Moran
*Attorney, Agent, or Firm*—Limbach & Limbach L.L.P.

[57] ABSTRACT

A glove or mitten, and method of making the same, includes a hand shaped liner disposed inside a shell. The glove or mitten shell includes a palm section having a central portion, at least one finger portion extending from the central portion, a thumb portion extending from the central portion, and a plurality of elastic members attached to the finger portions and thumb portion by a zig-zag shaped stitch to bias the finger/thumb portions toward the central portion. The elastic members help a wearer bend the finger portions of the glove toward the central portion for easier and more comfortable gripping.

18 Claims, 3 Drawing Sheets

METHOD AND APPARATUS FOR AN INSULATED GLOVE OR MITTEN WITH EASY TO BEND FINGER AND THUMB PORTIONS

FIELD OF THE INVENTION

The present invention relates to insulated gloves or mittens, and in particular to a method and apparatus for a glove/mitten having easy to bend finger and thumb portions despite having a thick layer of insulation.

BACKGROUND OF THE INVENTION

Currently, heavily insulated gloves, such as ski gloves, have an outer shell surrounding a thick and heavy insulation liner. The liner is necessary to protect the wearer from cold weather. The outer shell protects the liner from wear and tear, helps keep the liner dry, and provides better gripping action.

One problem with ski gloves is that it can be difficult to bend the finger and thumb portions of the glove to grip objects, such as ski poles. The thick and heavy insulation liner is not very pliable, and tends to bunch up in the finger and thumb joints as they are bent, which makes it difficult to comfortably bend the finger/thumb portions of the glove.

The prevalent prior art solution for a more pliable insulated glove is to contour the glove shell by making the finger and thumb portions slightly curved toward the palm portion of the glove. This makes it slightly easier to grip objects. However, a significant amount of such curvature is not feasible to further enhance glove gripping because it would be too difficult to put such gloves on or to flatten one's hand out while wearing such gloves. Further, contouring the glove still does not prevent glove material from bunching up in the finger and thumb joints. Therefore, prior art gloves are still quite stiff and fail to provide easy and comfortable bending of the finger and thumb portions for gripping objects.

There is a need for an insulated glove having finger and thumb portions that are comfortably and easily bendable for gripping objects.

SUMMARY OF THE INVENTION

The present invention solves the aforementioned problems by providing elastic members to the thumb and finger portions of gloves and mittens to help the wearer comfortably and easily bend those portions of the glove.

According to the present invention, the glove includes a shell shaped to fit over a wearer's hand and has a palm section. The palm section of the shell includes a central portion, finger portions extending from the central portion, a thumb portion extending from the central portion, and a plurality of elastic members attached to the finger portions to bias the finger portions toward the central portion. The elastic members help a wearer bend the finger portions of the glove toward the central portion for easier gripping.

In another aspect of the present invention, a mitten includes a shell shaped to fit over a wearer's hand and having a palm section. The palm section includes a central portion, a finger portion extending from the central portion, a thumb portion extending from the central portion, and at least one elastic member attached to the finger portion to bias the finger portion toward the central portion. The elastic member helps a wearer bend the finger portion of the mitten toward the central portion for easier gripping.

In yet another aspect of the present invention, a method of making a glove includes the steps of forming a glove shell with a palm section that has a central portion and finger portions extending from the central portion, and attaching a plurality of elastic members to the finger portions to bias the finger portions toward the central portion. The elastic members help a wearer bend the finger portions of the glove toward the central portion for easier gripping.

In still yet another aspect of the present invention, a method of making a mitten includes the steps of forming a mitten shell with a palm section that has a central portion and a finger portion extending from the central portion, and attaching at least one elastic member to the finger portion to bias the finger portion toward the central portion. The elastic member help a wearer bend the finger portion of the mitten toward the central portion for easier gripping.

Other objects and features of the present invention will become apparent by a review of the specification, claims and appended figures.

DETAILED DESCRIPTION OF THE PREFERRED EMBODIMENTS

Figure 1:
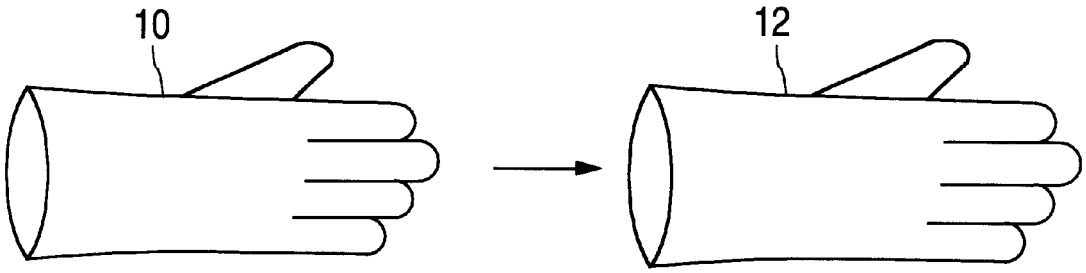
FIG. 1 is a top view of the insulating liner that inserts into the shell of the present invention.

The present invention is a method and apparatus for an improved insulated glove, which includes an insulation liner 10 inserted inside of a shell 12 as illustrated in FIG. 1.

The insulation liner 10 is well known in the art and is made of any material that thermally insulates a wearer's hand inserted therein. The insulation liner 10 is hand-shaped and may include water resistant and/or waterproof layer(s) of material.

Figure 2:
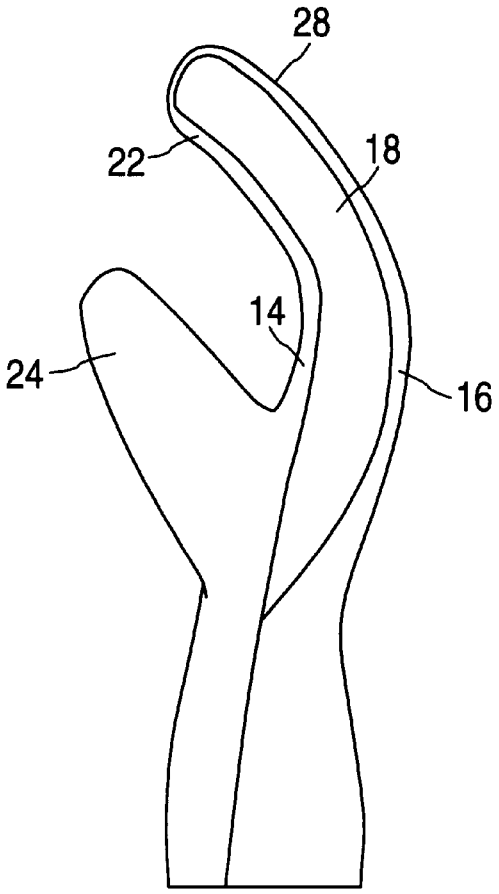
FIG. 2 is a side view of the glove shell of the present invention.

The shell 12 includes a hand-shaped palm section 14 and a hand-shaped gloveback section 16, as illustrated in FIG. 2. A side section 18 is attached between part of the palm and gloveback sections 14/16 to give the glove a three dimensional thickness.

Figure 3A:
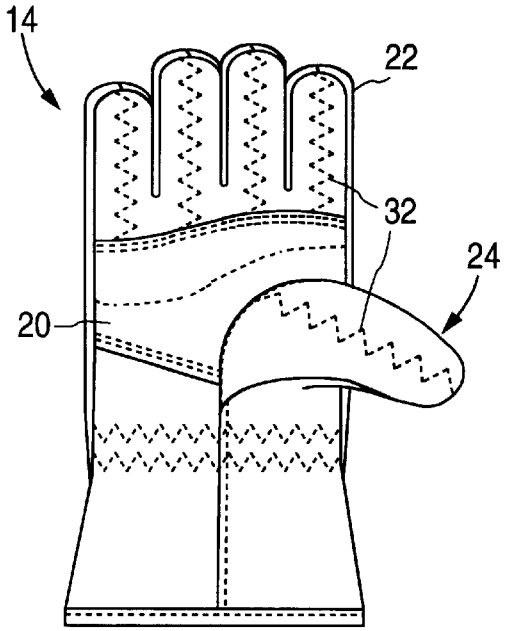
FIG. 3A is a front view of the palm section of the glove shell of the present invention.
Figure 3B:
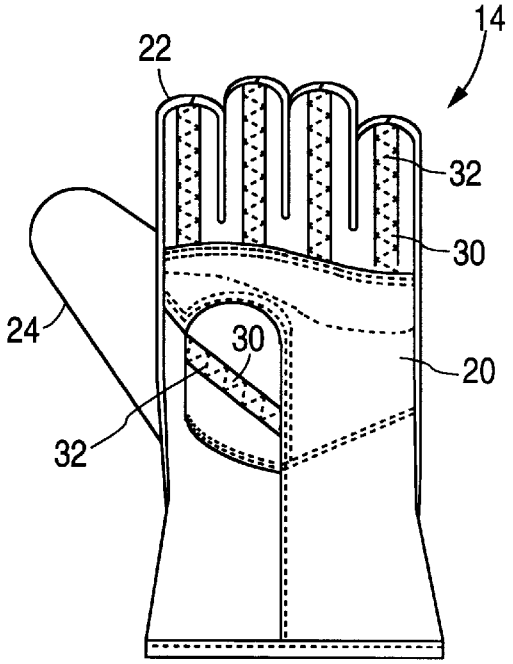
FIG. 3B is a back view of the palm section of the glove shell of the present invention.

The palm section 14 is better illustrated in FIGS. 3A and 3B, and includes a central palm area 20, finger portions 22, and a thumb portion 24 extending from the central palm area 20, to form the front shape of a hand.

Figure 4:
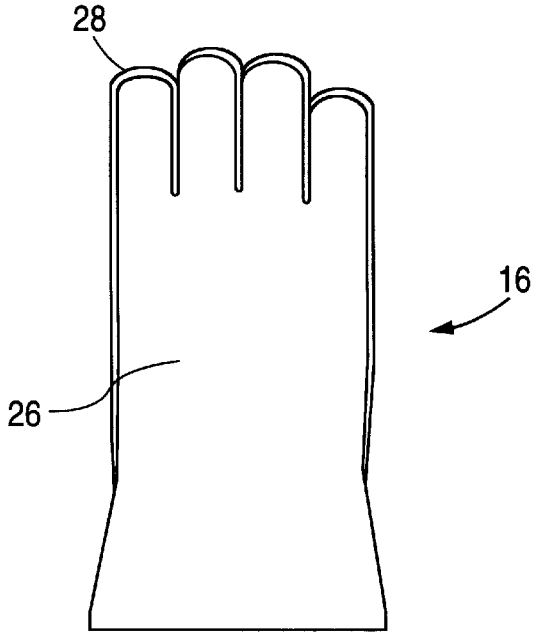
FIG. 4 is a back view of the gloveback section of the glove shell of the present invention.

The gloveback section 16 is better illustrated in FIG. 4, and includes a central area 26 and finger portions 28 to form the back shape of a hand.

The palm section 14 and gloveback section 16 can be formed of any one or more durable materials, such as leather, canvas or nylon. To form glove shell 12 for a right handed glove, the gloveback section of FIG. 4 is attached to the back of the palm section (illustrated in FIG. 3B), preferably by stitching. Side sections 18 are stitched in between the finger portions 22 and finger portions 28 to form the 3-dimensional glove shell 12. A left hand glove shell is made in a similar fashion with the dimensions shown reversed.

The finger portions 22 and thumb portion 24 of the palm section 14 include elastic members 30 attached to the inside surfaces thereof. The elastic members 30 of the preferred embodiment are elastic bands sewn to the finger and thumb portions 22/24 with a zig-zag stitching pattern 32. The tension from the elastic members 30 contracts and pulls forward finger/thumb portions 22/24 (along with any insulation liner portions disposed therein) toward the central area 20 of palm section 14. This forward force helps the wearer of the glove bend the finger/thumb portions 22/24 for gripping purposes. The tension from the elastic members 30 also helps draw the finger/thumb portions 22/24 (and any insulation liner portions disposed therein) away from the wearer's finger and thumb joints, thus allowing the wearer to more comfortably and easily bend the finger/thumb portions 22/24 to grip objects. The zig-zag stitched pattern 32 secures the elastic band 30 in place while allowing the elastic band 30 to repeatedly expand and contract as the wearer's hand grips and straightens out inside the glove.

Figure 5A:
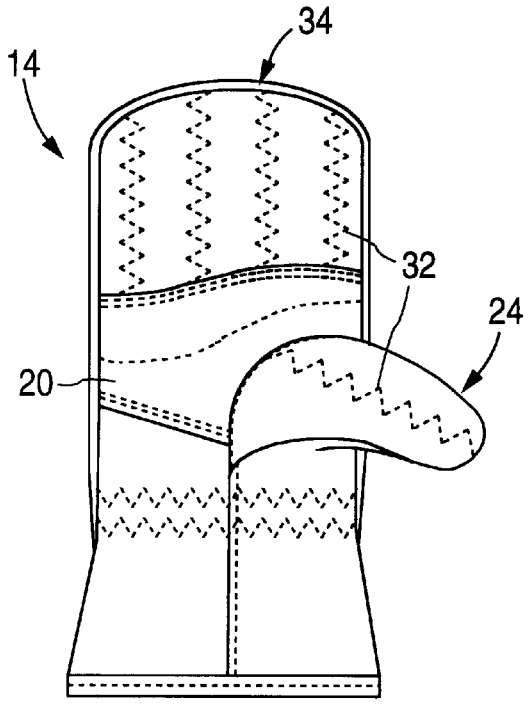
FIG. 5A is a front view of the palm section of an alternate embodiment of the present invention.
Figure 5B:
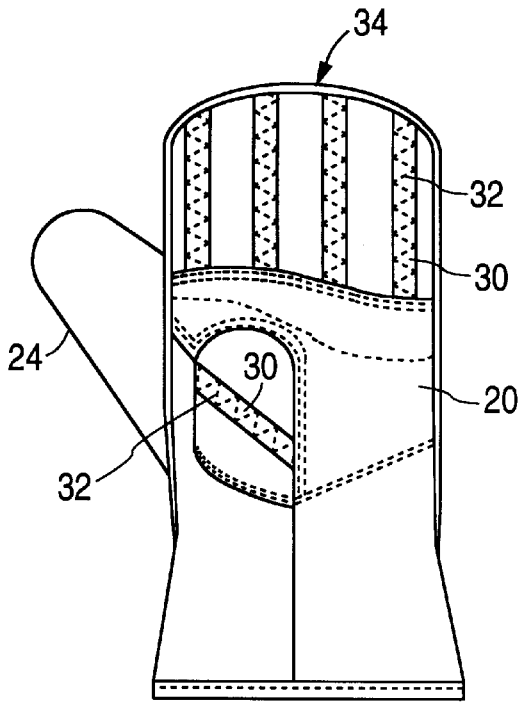
FIG. 5B is a back view of the palm section of the alternate embodiment of the present invention.
Figure 5C:
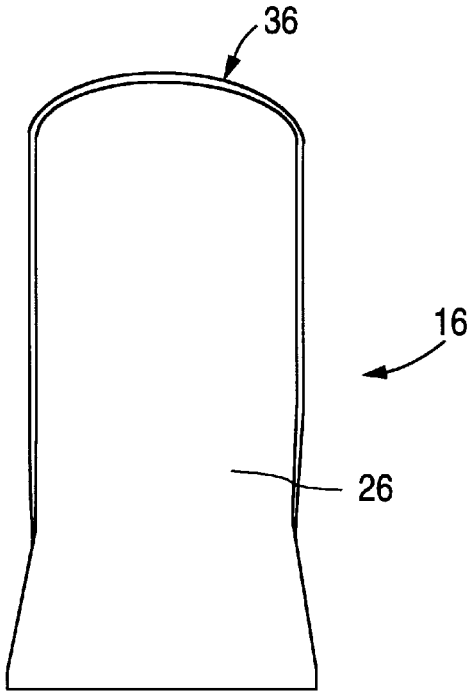
FIG. 5C is a back view of the gloveback section of the alternate embodiment of the present invention.

FIGS. 5A–5C illustrate an alternate embodiment of the present invention, where the finger portions 22 of palm section 14 are replaced by a single finger pocket portion 34, and the finger portions 28 of the gloveback section 16 are replaced by a single finger pocket portion 36, to form a mitten instead of a glove. The elastic members 30 are attached to the inside of the finger pocket portion 34 to help the wearer bend that portion to grip objects.

It is to be understood that the present invention is not limited to the embodiments described above and illustrated herein, but encompasses any and all variations falling within the scope of the appended claims. For example, either or both of the palm section or the gloveback section can include part or all of side sections 18, or no side section 18 may be necessary, so that there only two glove halves to assemble together to form 3-dimensional shell 12. Further, the elastic members can be used with any type of insulated or non-insulated glove. Lastly, the elastic members could be inserted in only select finger/thumb portions.

I claim:

1. A glove comprising:

a shell shaped to fit over a wearer's hand and having a palm section that includes:

a central portion, finger portions extending from the central portion, a thumb portion extending from the central portion, and a plurality of elastic members attached to the finger portions to bias the finger portions toward the central portion, and an elastic member attached to the thumb portion to bias the thumb portion toward the central portion;

wherein the elastic members help a wearer bend the thumb portion and the finger portions of the glove toward the central portion for easier gripping.

2. The glove of claim 1, wherein the elastic members in the finger portions are elastic bands that are attached to the finger portions by stitching formed in a zig-zag pattern.

3. The glove of claim 1, wherein the elastic member in the thumb portion is an elastic band that is attached to the thumb portion by stitching formed in a zig-zag pattern.

4. A glove comprising:

a shell shaped to fit over a wearer's hand and having a palm section that includes:

a central portion, finger portions extending from the central portion, a thumb portion extending from the central portion, and a plurality of elastic members attached to the finger portions to bias the finger portions toward the central portion; and a liner shaped to fit over a wearer's hand and disposed inside the shell, wherein the elastic members are attached to a surface of the finger portions that face the liner, and wherein the elastic members help a wearer bend the finger portions of the glove toward the central portion for easier gripping.

5. A mitten comprising:

a shell shaped to fit over a wearer's hand and having a palm section that includes:

a central portion, a finger portion extending from the central portion, a thumb portion extending from the central portion, and at least one elastic member attached to the finger portion to bias the finger portion toward the central portion;

wherein the elastic member helps a wearer bend the finger portion of the mitten toward the central portion for easier gripping.

6. The mitten of claim 5, further comprising:

an elastic member attached to the thumb portion to bias the thumb portion toward the central portion, wherein the elastic member helps a wearer bend the thumb portion of the mitten toward the central portion for easier gripping.

7. The mitten of claim 5, wherein the elastic member in the finger portion is an elastic band that is attached to the finger portion by stitching formed in a zig-zag pattern.

8. The mitten of claim 5, further comprising:

a liner shaped to fit over a wearer's hand and disposed inside the shell, wherein the elastic member is attached to a surface of the finger portion that faces the liner.

9. The mitten of claim 6, wherein the elastic member in the thumb portion is an elastic band that is attached to the thumb portion by stitching formed in a zig-zag pattern.

10. A method of making a glove, comprising the steps of:

forming a glove shell with a palm section that has a central portion and finger portions extending from the central portion;

forming a thumb portion that extends from the central portion;

attaching a plurality of elastic members to the finger portions to bias the finer portions toward the central portion;

attaching an elastic member to the thumb portion to bias the thumb portion toward the central portion;

wherein the elastic members in the thumb portion and the finger portions help a wearer bend the thumb portion and the finger portions of the glove toward the central portion for easier gripping.

11. The method of claim 10, wherein the attaching step includes stitching the elastic members to the finger portions with zig-zag shaped stitches.

12. The method of claim 10, wherein the attaching step includes stitching the elastic member to the thumb portion with a zig-zag shaped stitch.

13. A method of making a glove, comprising the steps of:

forming a glove shell with a palm section that has a central portion and finger portions extending from the central portion:

attaching a plurality of elastic members to the finger portions to bias the finger portions toward the central portion; and attaching a liner shaped to fit over a wearer's hand to an inside of the shell so that the elastic members are attached to a surface of the finger portions that face the liner;

wherein the elastic members help a wearer bend the finger portions of the glove toward the central portion for easier gripping.

14. A method of making a mitten, comprising the steps of:

forming a mitten shell with a palm section that has a central portion and a finger portion extending from the central portion; and attaching at least one elastic member to the finger portion to bias the finger portion toward the central portion;

wherein the elastic member help a wearer bend the finger portion of the mitten toward the central portion for easier gripping.

15. The method of claim 14, wherein:

the forming step includes forming a thumb portion that extends from the central portion, and the attaching step includes attaching an elastic member to the thumb portion to bias the thumb portion toward the central portion;

wherein the elastic member in the thumb portion helps a wearer bend the thumb portion of the mitten toward the central portion for easier gripping.

16. The method of claim 14, wherein the attaching step includes stitching the elastic member to the finger portion with zig-zag shaped stitches.

17. The method of claim 14, further comprising the step of:

attaching a liner shaped to fit over a wearer's hand to an inside of the shell so that the elastic member is attached to a surface of the finger portion that faces the liner.

18. The method of claim 15, wherein the attaching step includes stitching the elastic member to the thumb portion with a zig-zag shaped stitch.

* * * * *